US009525207B2

(12) United States Patent
Facco et al.

(10) Patent No.: US 9,525,207 B2
(45) Date of Patent: Dec. 20, 2016

(54) RECONFIGURABLE ANTENNA STRUCTURE WITH PARASITIC ELEMENTS

(71) Applicant: Adant Technologies, Inc., Santa Clara, CA (US)

(72) Inventors: Mauro Facco, Padua (IT); Francesco Sacchetto, Padua (IT); Daniele Piazza, Padua (IT)

(73) Assignee: ADANT TECHNOLOGIES, INC., Santa Clara, CA (US)

( * ) Notice: Subject to any disclaimer, the term of this patent is extended or adjusted under 35 U.S.C. 154(b) by 584 days.

(21) Appl. No.: 13/945,031

(22) Filed: Jul. 18, 2013

(65) Prior Publication Data

US 2015/0022412 A1 Jan. 22, 2015

(51) Int. Cl.

| | |
|---|---|
| ***H01Q 3/44*** | (2006.01) |
| ***H01Q 3/00*** | (2006.01) |
| ***H01Q 1/48*** | (2006.01) |
| ***H01Q 9/30*** | (2006.01) |

(52) U.S. Cl.
CPC ..... *H01Q 3/44* (2013.01); *H01Q 1/48* (2013.01); *H01Q 3/00* (2013.01); *H01Q 9/30* (2013.01)

(58) Field of Classification Search
CPC ..... H01Q 3/44; H01Q 3/00
See application file for complete search history.

(56) References Cited

U.S. PATENT DOCUMENTS

| | | | | |
|---|---|---|---|---|
| 2003/0193437 | A1 | 10/2003 | Kangasvieri et al. | |
| 2007/0182638 | A1 | 8/2007 | Rowell | |
| 2010/0214189 | A1 | 8/2010 | Kanazawa | |
| 2011/0309992 | A1 * | 12/2011 | Ali | H01Q 1/243 343/848 |

FOREIGN PATENT DOCUMENTS

WO WO-2010029306 A1 3/2010

OTHER PUBLICATIONS

Extended European Search Report issued Jan. 1, 2015 in European Application No. 14176057.9.

* cited by examiner

*Primary Examiner* — Hoang V Nguyen
*Assistant Examiner* — Michael Bouizza
(74) *Attorney, Agent, or Firm* — Polsinelli PC

(57) ABSTRACT

The present invention refers to a reconfigurable antenna structure. The antenna structure comprises an active radiating structure comprising at least an active radiating element, a passive radiating structure comprising at least a passive radiating element, a ground plane structure comprising at least a ground plane element and at least a first circuitry element to selectively electrically connect/disconnect said passive radiating element with/from said ground plane element. The ground plane structure comprises regulating means of the current distribution along said ground plane structure, when said antenna structure emits/receives an electromagnetic radiation.

16 Claims, 6 Drawing Sheets

RECONFIGURABLE ANTENNA STRUCTURE WITH PARASITIC ELEMENTS

FIELD OF INVENTION

The present invention refers to the field of adaptive antennas for the reception and/or transmission of radio frequency signals. In particular, the present invention refers to a reconfigurable antenna structure.

BACKGROUND OF INVENTION

The use of adaptive antenna systems is very widespread.

As is known, an adaptive antenna system is generally capable of dynamically altering its radiation characteristics in response to a variation in the characteristics of the channel for receiving and/or transmitting electromagnetic waves.

The characteristics of the reception and/or transmission channel, in turn, mainly depend on the type of device connected to the adaptive antenna system by means of the communication channel itself.

A known type of adaptive antenna systems is represented by reconfigurable antenna structures.

These devices are able to change the orientation of the radiation pattern lobes and/or the polarization of the radiated electromagnetic field by appropriately varying the spatial distribution of the antenna current flowing along the antenna structure.

Traditionally, a reconfigurable antenna structure comprises an active radiating element, electrically connected to a radio frequency source and/or receiving device.

In some known reconfigurable antenna structures, embedded switches or variable capacitors are arranged to change the current distribution along the active radiating element.

In other known reconfigurable antenna structures, passive radiating elements are operationally associated with the active radiating element.

According to some known solutions, the passive radiating elements can be electrically connected/disconnected with a ground plane by means of switching devices.

By operating said switching devices, the passive radiating elements can be short-circuited to ground, thereby varying their electrical length. In this way, they can operate as directors or reflectors of the electromagnetic radiation emitted/received by the active radiating element and vary the radiation characteristics of the antenna structure.

Known reconfigurable antenna structures of this type have some drawbacks.

When the ground plane of the antenna structure is relatively small and/or the distances between the active radiating element, the passive radiating elements and the ground plane are relatively short (as it often occurs in antenna structures having a planar geometry and realized by means of printed circuit manufacturing techniques), current coupling between the active and passive radiating elements is determined by the received/emitted electromagnetic radiation as well as by the currents flowing along the ground plane, which are conveyed by said received/emitted electromagnetic radiation.

When induced currents flow along the ground plane, the ground plane structure emits an electromagnetic radiation by itself, which can sum up in amplitude and phase with the radiation emitted/received by the active radiating element.

This contribution in emitted/received electromagnetic radiation causes a tilt of the radiation pattern of the antenna structure along the plane containing the active/passive radiating elements in their entire length (perpendicular to the azimuth plane).

Experimental tests have proven how said undesired tilt of the radiation pattern may reach also 30° in elevation. This leads to lower gain values and poor coverage along the azimuth plane, since the directivity is enhanced in an unwanted direction.

The performances of the antenna structure may thus remarkably decrease to unacceptable levels, in particular when it is integrated in electronic devices for point-to-point communications, such as access points, gateways, routers, and the like.

The main aim of the present invention is to provide a reconfigurable antenna structure that allows overcoming the aforesaid drawbacks.

A further object of the present invention is to provide an antenna structure that can offer high performance in terms of the configurability of its radiating characteristics along the azimuth plane and the elevation plane.

A further object of the present invention is to provide an antenna structure that can ensure excellent impedance adaptation to the reception and/or transmission channel, as its radiating characteristics vary.

Yet another object of the present invention is to provide an antenna structure that is easy to produce industrially, with relatively low costs, particularly when constructive geometries are adopted, in which the overall dimensions are significantly smaller than the operating wavelengths.

SUMMARY OF THE INVENTION

As part of a general definition, the antenna structure, according to the invention, comprises an active radiating structure comprising one or more active radiating elements.

Advantageously, the aforesaid active radiating structure is electrically connected to an electronic receiving device and/or an electronic transmitting device.

The antenna structure, according to the invention, comprises a passive radiating structure, operationally associated with said active radiating structure.

The aforesaid secondary radiating structure comprises one or more second passive radiating elements.

Preferably, said passive radiating elements have an equivalent electrical length that is shorter than the operating wavelengths.

The antenna structure, according to the invention, comprises a ground plane structure, operationally associated with said active and passive radiating structures.

The aforesaid ground plane structure comprises one or more ground plane elements, which may or may not be interconnected.

The antenna structure, according to the invention, comprises one or more first circuitry element to electrically connect/disconnect said passive radiating elements with/from said ground plane elements in a selective manner.

The aforesaid ground plane structure comprises regulating means of the current distribution along the ground plane structure (and consequently of the radiation pattern), when said antenna structure emits/receives an electromagnetic radiation.

Advantageously, said regulating means force the current flowing along the ground plane structure to follow a predefined path, when said antenna structure emits/receives an electromagnetic radiation, in particular when said passive radiating elements are electrically connected to the ground plane structure.

Preferably, the aforesaid regulating means of the current distribution along the ground plane structure comprise at least a slot or cut-out obtained in the ground plane elements.

Preferably, said regulating means comprise one or more second circuitry elements to electrically connect/disconnect, in a selective manner, portions of ground plane elements, which are separated by said slot or cut-outs.

Preferably, said active radiating elements, said passive radiating elements and said ground plane elements are formed by respective conductive tracks deposited on one or more surfaces of a supporting substrate.

Preferably, the antenna structure, according to the invention, comprises one or more bias lines electrically connected to a driving circuit to power said first circuitry elements and/or said second circuitry elements.

Preferably, the antenna structure, according to the invention, comprises one or more third circuitry elements to electrically decouple said bias lines from the RF path of antenna currents.

The antenna structure, according to the present invention, allows controlling the radiation patterns along the azimuth and the elevation plane.

The antenna structure, according to the present invention, may be easy realised as a small monopole reconfigurable antenna capable of radiating omni-directional and directional modes with high peak gains along the azimuth plane.

The antenna structure, according to the present invention, therefore allows strongly controlling the directivity of the radiation lobes.

The antenna structure, according to the present invention, is relatively simple to realize at industrial level, adopting compact planar geometries.

BRIEF DESCRIPTION OF THE DRAWINGS

Further characteristics and advantages of the present invention will be more apparent with reference to the description given below and to the accompanying figures, provided purely for explanatory and non-limiting purposes, wherein.

DETAILED DESCRIPTION OF THE INVENTION

Figure 1:
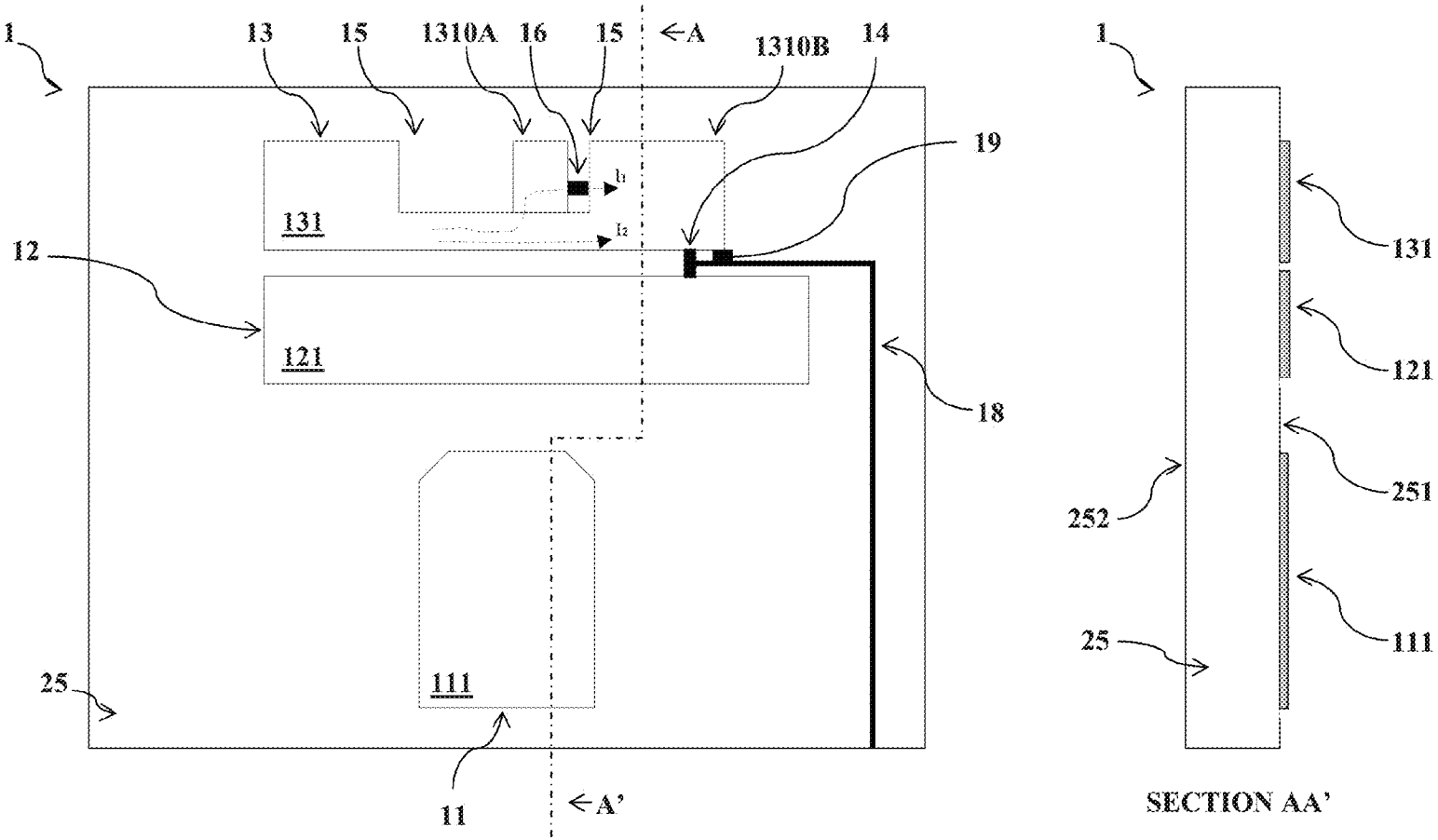
FIG. 1 shows a schematic view of the antenna structure, according to the present invention, in a first embodiment.

With reference to the aforementioned figures, the present invention relates to a reconfigurable antenna structure 1, 1A.

The antenna structure 1, 1A comprises an active radiating structure 11 to receive and/or transmit an electromagnetic radiation in radio frequency.

The definition of electromagnetic radiation in radio frequency, in the context of the present invention, refers to an electromagnetic radiation with a carrier frequency between 1 Hz and 300 GHz, preferably between 300 MHz and 70 GHz.

The radiating structure 11 operates as an "active" radiating structure, since it is advantageously electrically connected to an electronic receiving device and/or an electronic transmitting device (not shown).

When the antenna structure 1, 1A receives an electromagnetic radiation from the surrounding space, the radiating structure 11 transmits a reception signal to the electronic receiving device which processes said signal as required, for example by means of demodulation or decryption processing of the signal.

When the antenna structure 1, 1A transmits an electromagnetic radiation into the surrounding space, the radiating structure 11 receives an antenna current signal from the electronic transmitting device (for example a radio frequency source), which results in the emission of electromagnetic radiation by the radiating structure 11.

Preferably, the transmitting/receiving device has an unbalanced electrical connection to ground. The antenna structure 1, 1A has thus a substantially unbalanced monopole radiating structure.

The radiating structure 11 comprises one or more active radiating elements 111.

In certain embodiments (FIGS. 1-3), the radiating structure 11 comprises a single radiating element 111.

According to other embodiments (not shown), the radiating structure 11 might comprise several radiating elements that are electrically connected to each other so as to form a single radiating body.

The number of configurations and arrangements for the radiating structure 11 can be advantageously determined as a function of its desired impedance value, which in turn depends on the characteristic operating frequency band of the antenna structure 1, 1A.

In possible embodiments of the present invention (not shown), one or more radiating elements 111 having a linear shape, a fork shape, a ring shape or a polygonal shape may be adopted.

The antenna structure 1, 1A comprises a passive radiating structure 12, operationally associated with the primary radiating structure 11.

As will be better seen below, the radiating structure 12 can reflect and/or direct, at least partially, the electromagnetic radiation received and/or transmitted by the primary radiating structure 11.

The secondary structure 12 operates a "passive" radiating structure, since it is not electrically connected directly to an electronic receiving/transmitting device.

The secondary structure 12 comprises one or more second radiating elements 121, 121A, 121B.

In certain embodiments (FIG. 1), the radiating structure 12 comprises a single radiating element 121.

According to other embodiments (FIGS. 2-3), the radiating structure 12 comprises a plurality of radiating elements 121A, 121B.

According to some embodiments (not shown), the antenna structure 1 may comprise one or more first reactive loads (e.g. of capacitive type) electrically connected to the radiating structures 11, 12.

According to further embodiments (not shown), the antenna structure 1 may also comprise one or more second reactive loads (e.g. of inductive type) electrically connected to the radiating structure 12.

The second reactive loads are advantageously of a different type from the first reactive loads.

Thus, if the first reactive loads are of a capacitive type, the second reactive loads are of an inductive type, and vice-versa.

The value of the first and second reactive loads is advantageously selected as a function of the operating bandwidth of the antenna structure 1.

The passive radiating elements 121, 121A, 121B may have any shape, according to the needs. For example, they may have a linear shape, a ring shape or a polygonal shape.

Preferably, the passive radiating elements 121, 121A, 121B are shaped so as to have equivalent electric lengths much shorter than the operating wavelengths. For example, they may have equivalent electric lengths shorter than $\lambda/4$, where $\lambda$ is the wavelength corresponding to the aforementioned operating frequency.

The antenna structure 1 comprises a ground plane structure 13, operationally associated with the radiating structures 11 and 12.

The ground plane structure 13 is permanently short-circuited to a ground terminal (not shown) of the antenna structure 1.

The ground plane structure 13 comprises one or more ground plane elements 131, 131A, 131B, 131C.

In certain embodiments (FIG. 1), the ground plane structure 13 comprises a single ground plane element 131.

In other embodiments (FIG. 2-3), the ground plane structure 13 comprises a plurality of ground plane elements 131A, 131B, 131C.

In principle, the ground plane elements 131, 131A, 131B, 131C may have an overall shape that can be configured according to the needs. For example, they may be arranged as rectangular, squared, ring or polygonal conductive pads.

The antenna structure 1 comprises one or more first circuitry elements 14, 14A, 14B to selectively electrically connect/disconnect the passive radiating elements 121, 121A, 121B of the radiating structure 12 with/from the ground plane elements 131, 131A, 131B, 131C of the ground plane structure 13.

Preferably, the first circuitry elements 14, 14A, 14B comprise one or more switching devices, for example discrete or integrated transistors, electrically connected between the radiating elements of the radiating structure 12, so as to be able to permit/prevent the formation of conductive paths between said elements and the ground plane elements of the ground plane structure 13.

As an example, when a switching element 14, 14A, 14B is switched in an ON/OFF state (i.e. a conducting/non-conducting state), a conductive path between a passive radiating element 121, 121A, 121B and a ground plane element 131, 131A, 131B, 131C is formed/interrupted.

Preferably, the antenna structure 1 is operationally associated with a control device (not shown) to generate appropriate command signals to turn the switching devices 14, 14A, 14B in an ON/OFF state.

Embodiments of the present invention may be provided with the aforementioned control device integrated with the antenna structure 1.

As an alternative, the circuitry elements 14, 14A, 14B may be formed by variable capacitors or PIN diodes.

Thanks to the presence of the ground plane structure 13, the antenna structure 1, 1A, notwithstanding being substantially structured as a transmitting/receiving monopole, operates (according to the well known principle of image theory) like a Hertzian dipole that is virtually formed by the active plane structure 11 and the ground plane structure 13.

The antenna structure 1, 1A can dynamically change its radiation diagram by properly commanding the circuitry elements 14, 14A, 14B.

By creating/preventing the formation of conductive paths towards the ground plane elements 131, 131A, 131B, the circuitry elements 14, 14A, 14B can dynamically vary the equivalent electrical length of the passive radiating elements 121, 121A, 121B and thereby change the configuration of the radiating structure 12.

For the sake of clarity, the radiating structure 12 is considered to vary its configuration when there is a variation in the spatial distribution of the antenna current flowing in it.

A variation in the configuration of the radiating structure 12 obviously results in a variation in the radiating properties of the antenna structure 1, particularly in the radiation diagram and/or in the polarization of the radiated electromagnetic field.

As an example, a group formed by a radiating element 121, 121A, 121B and a ground plane element 131, 131A, 131B (when said elements are electrically connected by circuitry elements 14, 14A, 14B in an ON state) can operate as a reflector or a director of the electromagnetic radiation emitted/received by the radiating element 11, depending on whether the equivalent electrical length of such a group is respectively longer or shorter than the radiating element 111.

As a further example, if the radiating elements 121, 121A, 121B have an equivalent electrical length that is much shorter than the operating wavelengths, the antenna structure 1, 1A operates like a Hertzian dipole having an omni-directional radiation pattern, when all the circuitry elements 14, 14A, 14B are commanded (OFF state) to prevent the formation of conductive paths between the structures 12, 13.

It is worthy to notice that a variation in the configuration of the radiating structure 12 results in a variation in the radiating properties of the antenna structure 1, if the structures 11, 12, 133 are mutually positioned at suitable distances that must be calculated in relation to the operating wavelengths. Typical distances between the elements of the structures 11, 12, 13 are shorter than ¼ of the operating wavelengths.

According to the invention, the ground plane structure 13 comprises regulating means 15, 16, 16A, 16B of the distribution of current flowing along said structure, when the antenna structure 1 emits/receives an electromagnetic radiation.

Advantageously, the regulating means 15, 16, 15A, 15B, 16A, 16B force the current flowing along the ground plane structure 13 to follow a predefined path.

Since it is forced to follow said predefined path, the current flowing along the ground plane structure 13 is forced to have an amplitude and phase, which allow keeping the radiation emitted/received by the active radiating element 121, 121A, 121B mainly in the azimuth plane.

The phase and amplitude of this current distribution is controlled such that its radiated field sums up in the azimuth plane, leading therefore to maximum gain the in the desired plane and direction.

The regulating means 15, 15A, 15B, 16, 16A, 16B introduce amplitude and phase variations (with respect to the amplitude and phase of currents flowing along the active structure 11) in the induced current flowing along the ground plane structure 13.

The tilt of the radiation pattern in the plane containing the active/passive radiating elements in their entire length can thus be effectively controlled and remarkably reduced.

Preferably, said regulating means comprises one or more slots or cut-outs 15, 15A, 15B obtained in the ground plane elements of the ground plane structure 13.

The slots or cut-outs 15, 15A, 15B are advantageously shaped depending on the amplitude and phase variations to be introduced in the induced currents flowing along the ground plane structure.

The slots or cut-outs 15, 15A, 15B in fact introduce amplitude and phase variations (with respect to the amplitude and phase of currents flowing along the active structure 11) in the induced current flowing along the ground plane structure 13.

According to some embodiments (FIG. 1), the slots or cut-outs 15, 15A, 15B may be shaped to partially separate portions of a ground plane element of the ground plane structure 13.

According to other embodiments (FIG. 2), they may be shaped to completely separate portions of a ground plane element of the ground plane structure 13.

Preferably, said regulating means comprises one or more second circuitry elements 16, 16A, 16B to selectively electrically connect/disconnect portions of the ground plane elements of the ground plane structure, which are separated, at least partially, by a slot or cut-out 15, 15A, 15B.

Second circuitry elements 16, 16A, 16B are advantageously positioned between mutually facing portions of a same ground plane element, which are separated, at least partially, by a slot or cut-out 15, 15A, 15B.

Preferably, the second circuitry elements 16, 16A, 16B comprise one or more switching devices, for example discrete or integrated transistors, electrically connected between the separated portions of the ground plane elements 131, 131A, 131B, 131C, so as to be able to permit/prevent the formation of a conductive path between said portions.

As an example, when a switching device 16, 16A, 16B is switched in an OFF/ON state, a conductive path between opposite portions of a same ground plane element (across the slot or cut-out 15, 15A, 15B) is formed/interrupted.

By dynamically allowing/preventing the formation of conductive paths across the slots or cut-outs 15, 15A, 15B, the switching devices 16, 16A, 16B can introduce selective amplitude and phase variations (with respect to the amplitude and phase of currents flowing along the active structure 11) in the induced current flowing along the ground plane structure 13.

This allows dynamically controlling the distribution of the induced current along the ground plane structure 11 and therefore the tilt of the radiation pattern along the elevation plane.

Preferably, also the switching devices 16, 16A, 16B are driven by a control device (not shown) operatively associated with the antenna structure 1 to generate appropriate command signals to enable/disable said switching devices.

As an alternative, the circuitry elements 16, 16A, 16B may be formed by variable capacitors or PIN diodes.

Preferably, the antenna structure 1 comprises one or more bias lines 18, 18A, 18B to power the circuitry elements 14, 14A, 14B, 16, 16A, 16B.

Preferably, the bias lines 18, 18A, 18B are electrically connected to a driving circuit (not shown), which may be the same control device for controlling the switching devices 14, 14A, 14B, 16, 16A, 16B.

Preferably, the antenna structure 1 comprises one or more third circuitry elements 19, 19A, 19B to electrically decouple the bias lines 18, 18A, 18B from each other and/or from the passive radiating elements 121, 121A, 121B.

Preferably, the circuitry elements 19, 19A, 19B are choke inductors placed in proximity of the switching devices 14, 14A, 14B, 16, 16A, 16B.

Preferably, the antenna structure 1 has a planar overall geometry with overall dimensions significantly smaller than the characteristic wavelengths of the operating bandwidth.

For example, with reference to an operating frequency of 2.48 GHz, the antenna structure can be made with overall dimensions of around $\lambda/4\times\lambda/4$, where $\lambda$ is the wavelength corresponding to the aforementioned operating frequency.

The radiating elements 111, 121, 121A, 121B of the radiating structures 11, 12 and the ground plane elements 131, 131A, 131B, 131C of the ground plane structure 13 may consist of conducting tracks, which are deposited (by means of printed-circuit manufacturing techniques) on a first layer 251 and/or a second layer 252 of a supporting substrate 25, for example a support for printed circuits.

Preferably, the conductive tracks forming the radiating elements 111, 121, 121A, 121B of the radiating structures 11, 12 are deposited on a same surface 251 of the supporting substrate 25.

Ground plane elements 131, 131A, 131B, 131C of the ground plane structure 13 may be deposited on the same surface 251 or on an opposite surface 252 of the supporting substrate 25.

Also the bias lines 18, 18A, 18B may be formed by corresponding conductive tracks deposited on the surfaces 251 and/or 252 of the supporting substrate 25. Since they advantageously have high impedance, bias lines 18, 18A, 18B are designed so as to have high values of sheet resistance (measured in ohms/square or ohms/aspect ratio).

The circuitry elements 14, 14A, 14B or 16, 16A, 16B may consist, for example, of SMD (Surface Mounted Devices) type electronic components mounted on the surfaces 251 and/or 252.

Possible reactive loads electrically connected to the radiating elements 111, 121, 121A, 121B of the radiating structures 11, 12 may be formed by corresponding conductive tracks deposited on the surfaces 251 and/or 252 of the supporting substrate 25.

When conductive tracks or circuitry elements are positioned on the opposite surfaces 251, 252 of the substrate 25, they may be electrically connected by means of appropriate connections ("via holes") passing through the thickness of the substrate 25.

In FIG. 1, it is shown an example of antenna structure 1, according to the invention.

The antenna structure 1 comprises an active radiating structure 11 having a single active radiating element 111, a passive radiating structure 12 having a single passive radiating element 121 and a ground plane structure 13 having a single ground plane element 131.

The equivalent electrical length of the radiating element 121 is very short ($<\lambda/4$) with respect to the operating wavelengths.

The radiating elements 111, 121 and the ground plane element 131 are advantageously formed by conductive tracks deposited on a same surface 251 of the supporting substrate 25.

The antenna structure 1 comprises a first circuitry element 14, which is advantageously formed by a switching device powered by a bias line 18 that is deposited on the surface 251 of the supporting substrate.

A choke inductor 19 is positioned on the surface 251 in proximity of the switching device 14.

In the antenna structure 1, the regulating means comprise slots 15 that are obtained in the ground plane element 131, the which, in this case, has a resulting comb-like shape.

In the antenna structure 1, the regulating means comprise also the second circuitry element 16, which is advantageously formed by a switching device powered by a bias line (not shown) that is deposited on the surface 251.

The switching device 16 is positioned so as to enable/prevent the formation of a conductive path between opposite portions 1310A and 1310B of the ground plane element 131, which are separated by the slot 15.

By operating the switching device 14, it is possible to modify the radiation diagram of the antenna structure 1.

Since the radiating element 121 has a short equivalent electrical length with respect to the operating wavelengths, the antenna structure 1 shows an omni-directional radiation diagram when the switching device 14 in an OFF state.

When the switching device 14 is in an ON state, the group formed by the electrically connected radiating element 121 and the ground plane element 131 may operate as director or reflector depending on its equivalent electrical length.

If the equivalent electrical length is slightly longer than the typical operating wavelengths, said group acts as a reflector and directs the electromagnetic radiation in a direction opposite to that in which it is positioned in relation to the radiating structure 11.

If the equivalent electrical length is slightly shorter than the typical operating wavelengths, said acts as a director and directs the electromagnetic radiation in the same direction as that in which it is positioned in relation to the radiating structure 11.

The presence of the slots 15 forces the induced current flowing along ground plane element 131 to follow only some predefined paths, along which said current has amplitude and phase that are different from the electromagnetic radiation emitted/received by the radiating structure 11.

The amount of the amplitude variation and/or phase delay that is introduced depends on the geometry of the slots 15.

In this way, the electromagnetic radiation emitted by the ground plane structure does not sum up with the electromagnetic radiation emitted/received by the radiating structure 11 in an unwanted direction.

It is therefore possible to reduce the tilt of the radiation lobes along the plane containing the radiating elements, according to the needs.

By operating the switching device 16, it is possible to further modify the current distribution in the ground plane element 131, according to the needs, e.g. by selecting the possible path configurations $I_1$, $I_2$.

In this way, it is possible to dynamically select the tilt of the radiation lobes along the elevation plane.

Figure 2:
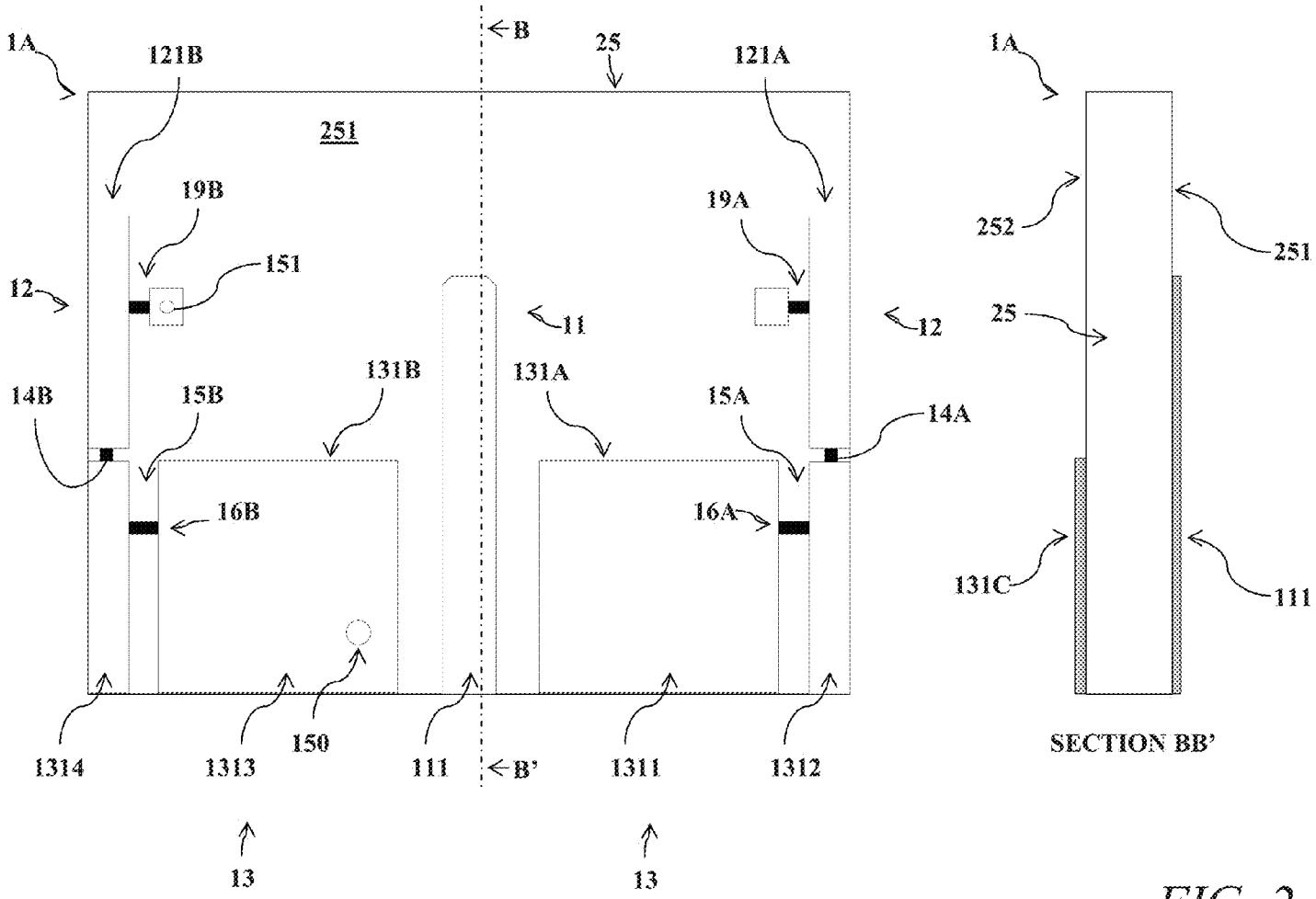
FIGS. 2-3 show schematic views of the antenna structure, according to the present invention, in a further embodiment.
Figure 3:
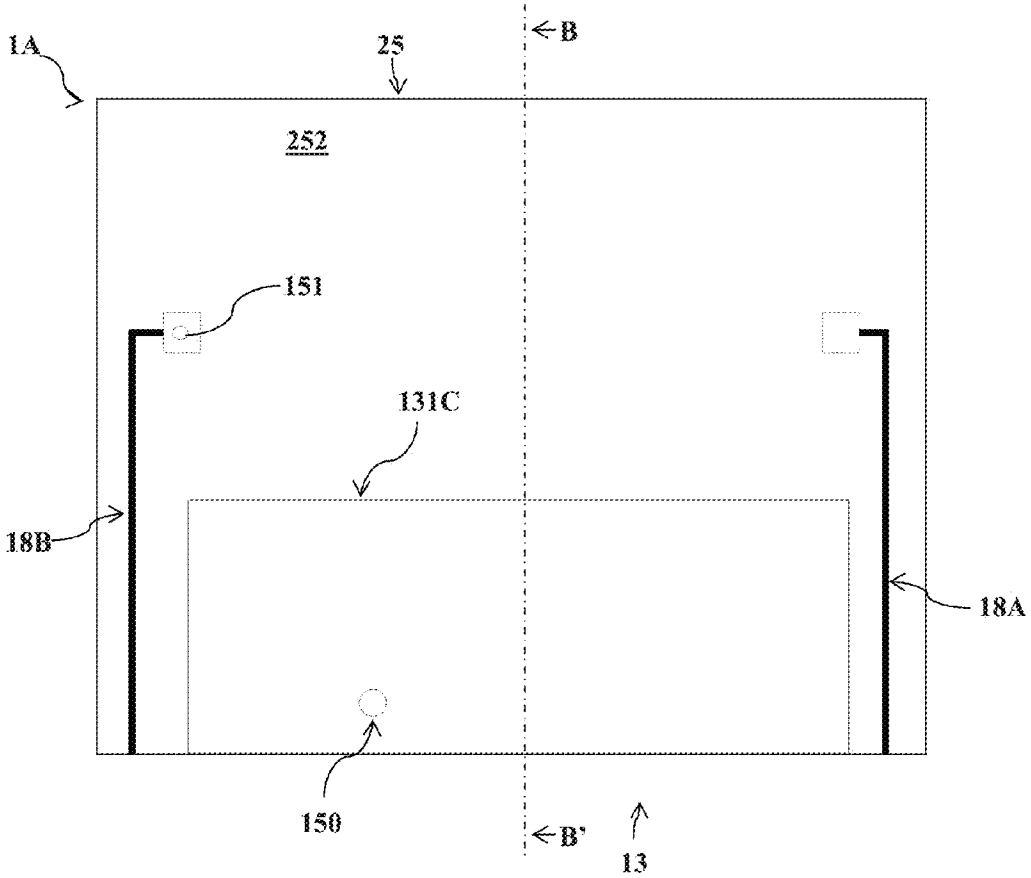

In FIG. 2, it is shown a further example of antenna structure 1A, according to the invention.

The active radiating structure 11 comprises a single active radiating element 111, which is formed by a first conductive track deposited on a first layer 251 of the supporting substrate 25.

The passive radiating structure 12 comprises a first and second passive radiating element 121A, 121B, which are formed by a second and a third conductive track deposited on the first layer 251.

The equivalent electrical length of the radiating elements 121A, 121B is very short ($<\lambda/4$) with respect to the operating wavelengths of the antenna structure.

The ground plane structure 13 comprises a first and second ground plane element 131A, 131B, which are formed by a fourth and a fifth conductive track deposited on the first layer 251.

The ground plane element 131A has a first portion 1311 and a second portion 1312, which are separated by a first cut-out 15A while the second ground plane element 131B has a third portion 1313 and a fourth portion 1314, which are separated by a second cut-out 15B.

First circuitry elements 14A, 14B are arranged to selectively electrically connect/disconnect the radiating elements 121A, 121B respectively with/from the second and fourth portions 1312, 1314.

The circuitry elements 14A, 14B are switching devices, which are positioned at the first layer 251 and which are powered by respective bias lines 18A, 18B electrically connected to a driving circuit.

The bias lines 18A, 18B are formed by thin tracks deposited on a second layer 252 of the supporting substrate 25, opposite to the surface 251.

Second circuitry elements 16A, 16B may be arranged to selectively electrically connect/disconnect the first and third portion 1311, 1313 respectively with/from the second and fourth portion 1312, 1314.

The circuitry elements 16A, 16B may be switching devices, which are positioned at the first layer 251 and which are powered by respective bias lines (not shown) electrically connected to a driving circuit and formed by thin tracks deposited on a second layer 252.

The ground plane structure 13 comprises also a third ground plane element 131C, which is formed by a sixth conductive track deposited on the second layer 252.

The ground plane element 131C is electrically connected to the first and second ground plane elements 131A, 131B by means of via holes 150.

Third circuitry elements 19A, 19B (e.g. choke inductors) are arranged to electrically decouple the bias lines 18A, 18B (and the other bias lines) from the radiating elements 121A, 121B.

Choke inductors 19A, 19B are positioned on the surface 251 of the substrate 25 and are electrically coupled with the bias lines 18A, 18B by means of via holes 151.

Figure 4:
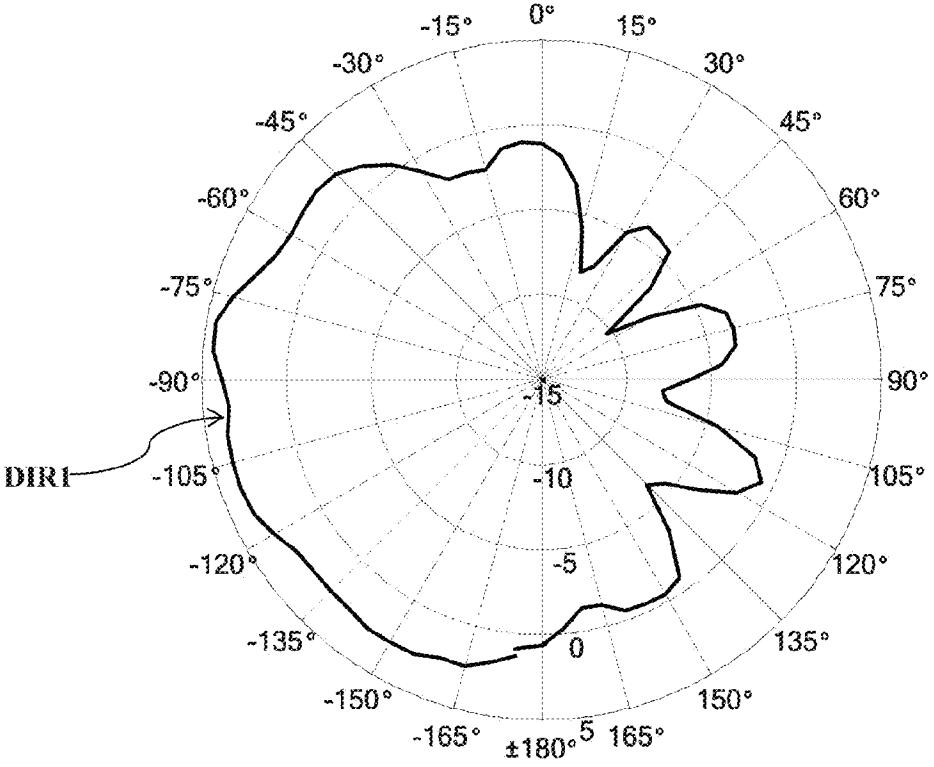
FIGS. 4-6 show graphs relating to the operation of an antenna structure shown in FIGS. 2-3.
Figure 5:
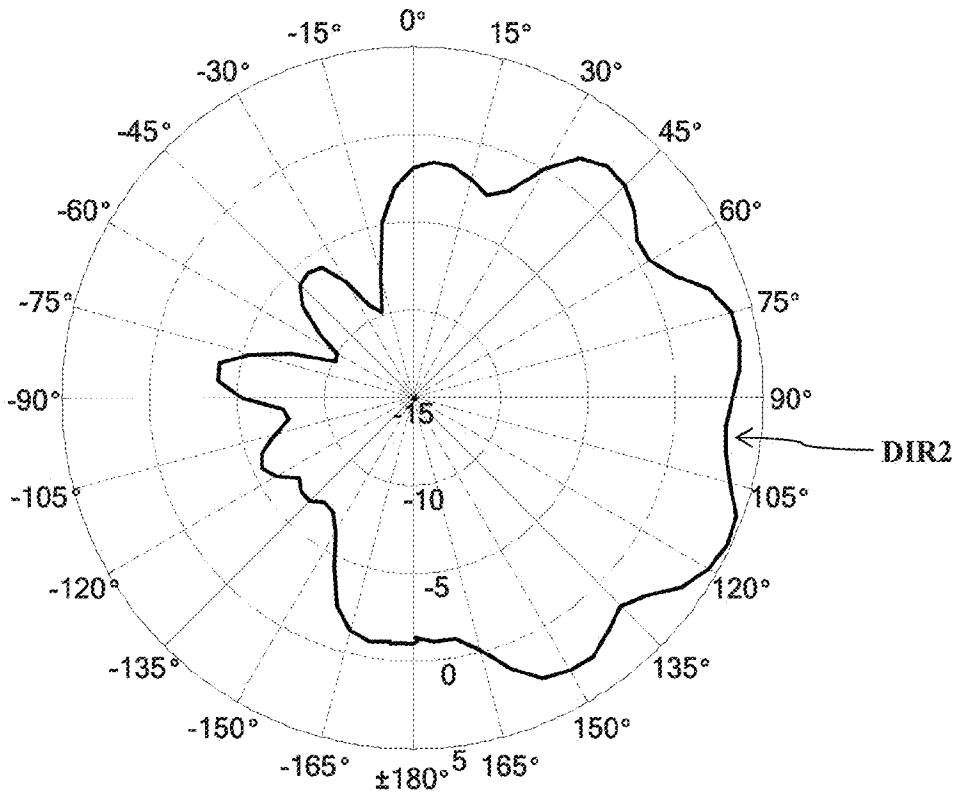
Figure 6:
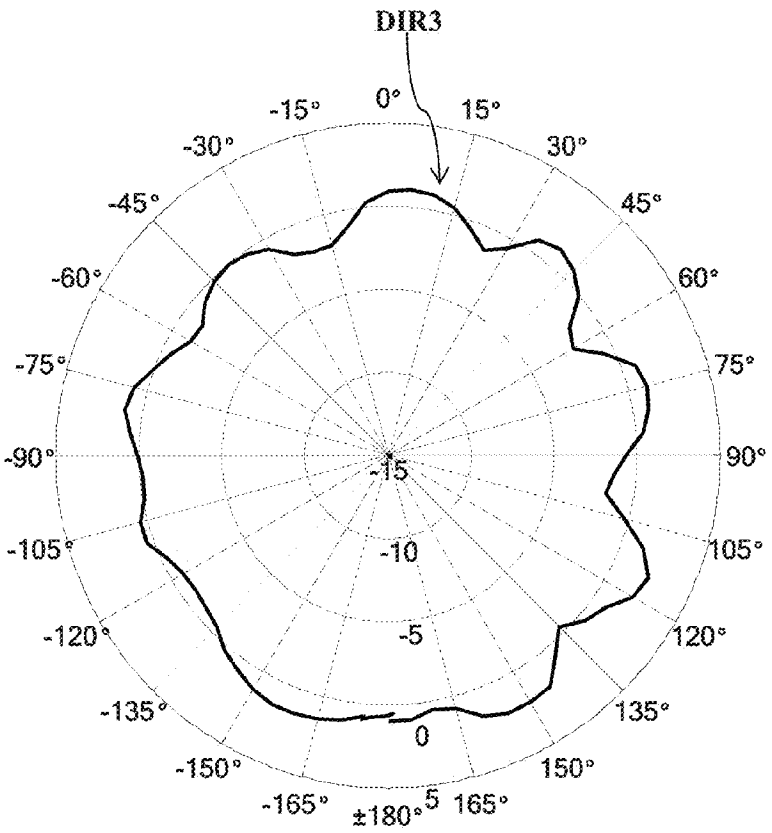

As it can be appreciated by FIGS. 4-6, the antenna structure 1A is capable of selectively varying its radiating characteristics, for example its radiation diagram.

When the switching elements 14A, 14B are all in a non-conducting state (OFF), there are no conductive paths between the radiating structure 12 and the ground plane 13.

Being the equivalent electrical length of the radiating elements 121A, 121B much shorter than the operating wavelengths, the antenna structure 1A shows an omni-directional radiation pattern (e.g. DIR3 in FIG. 6) in this case.

By properly commanding the switching elements 14A, 14B to switch in an ON state, it is possible to electrically connect the radiating elements 121A, 121B with the corresponding ground plane elements 131, 131B.

In these cases, the antenna structure 1A shows directional radiation patterns (e.g. the patterns DIR1 or DIR2 in FIG. 4 and FIG. 5).

Cut-outs 15A, 15B force the induced current flowing along ground plane elements 131A, 131B to follow only some predefined paths, along which said current has amplitude and phase that are different from the electromagnetic radiation emitted/received by the radiating structure 11.

The amount of the amplitude variation and/or phase delay that is introduced depends on the width of the cut-outs 15A, 15B, (and/or on the lumped element 16 in an alternative embodiment).

In this way, it is possible to reduce the tilt of the radiation lobes along the elevation plane, according to the needs.

By using switching devices or variable capacitors for 16A, 16B, it is possible to further modify the distribution of the induced current in the ground plane elements 131A, 131B, according to the needs.

In this way, it is possible to dynamically select the tilt of the radiation lobes along the elevation plane.

The antenna structure 1 may be subject to modifications or variants, all of which fall within the scope of the present invention.

For example, each radiating element 121, 121A, 121B of the radiating structure 12 may comprise a plurality of separated portions that might be electrically connected/disconnected to each other in a selective manner (by means of properly arranged switching circuitry) to further vary the configuration of the secondary radiating structure 12.

The radiating structures 11, 12 and the ground plane structure 13 may be differently shaped with respect to the described embodiments.

In particular, the shape of the radiating elements 111, 121, 121A, 121B may be of any type, according to the specific needs, e.g. a T-like shape, a L-like shape or the like, a fork-like shape, a meandered shape or a folded shape in general.

It has been shown in practice how the antenna structure 1, 1A, according to the present invention, allows the proposed aim and the objects to be fully achieved.

The antenna structure 1, 1A is able to effectively reconfigure its radiation diagram as required, through the full azimuth angle, The antenna structure 1, 1A can also control the radiation pattern along the elevation plane, thereby ensuring relatively high gains in a pre-defined direction, which may be along the azimuth plane.

The antenna structure 1 has a layout that is relatively simple to produce using common techniques for producing printed circuits.

Alternatively, the antenna structure 1 could be made using manufacturing techniques typically used for the industrial manufacture of integrated circuits, or using "silicon micromachining" techniques or similar.

The antenna structure 1 is therefore relatively easy and economical to produce industrially.

The antenna structure 1 can be advantageously used for communication purposes in wireless access points, routers, wireless access gateways, microcells, picocells, femtocells, tablets, notebooks, portable communication devices, automotive communication devices, communication interfaces and other electronic devices of similar type.

The invention claimed is:

1. Antenna structure-comprising:

an active radiating structure-comprising at least an active radiating element;

a passive radiating structure comprising at least a passive radiating element that can at least partially reflect and/or direct the electromagnetic radiation received and/or transmitted by the active radiating structure, and lacking an electrical pathway to the active radiating element;

a ground plane structure comprising at least a ground plane element having a slot or cut-out, and lacking an electrical pathway to the active radiating element;

at least a first circuitry to selectively electrically connect/disconnect said passive radiating element with/from said ground plane element;

wherein said ground plane structure comprises regulating means for controlling the current distribution along said ground plane structure and, consequently, the radiation pattern of the antenna, when said antenna structure emits/receives an electromagnetic radiation; and wherein said regulating means comprise at least a second circuitry to selectively electrically connect/disconnect portions of said ground plane element, which are separated by said slot or cut-out.

2. The antenna structure, according to claim 1, wherein said second circuitry controls the amplitude and phase of the current ($I_1$) flowing across said slot or cut-out.

3. The antenna structure according to claim 1, wherein said active radiating element, said passive radiating element and said ground plane element are formed by respective conductive tracks deposited on one or more layers of a supporting substrate.

4. The antenna structure according to claim 1, which comprises one or more bias lines electrically connected to a driving circuit to power said first circuitry and/or said second circuitry.

5. The antenna structure according to claim 4, wherein it comprises at least a third circuitry to electrically decouple said bias lines from said passive radiating elements.

6. The antenna structure according to claim 1, wherein said passive radiating elements have an equivalent electrical length that is shorter than the operating wavelengths.

7. The antenna structure according to claim 1, wherein:

said active radiating structure comprises an active radiating element, which is formed by a first conductive track deposited on a first layer of a supporting substrate;

said passive radiating structure comprises a first and second passive radiating elements, which are formed by a second and a third conductive track deposited on said first layer;

said ground plane structure comprises a first and second ground plane element, which are formed by a fourth and a fifth conductive track deposited on said first layer, said first ground plane element having a first portion and a second portion, which are separated by a first cut-out, said second ground plane element having a third portion and a fourth portion, which are separated by a second cut-out;

said first circuitry selectively electrically connect/disconnect said first and second passive radiating elements respectively with/from the second portion-of said first ground plane element and with/from the fourth portion-of said second ground plane element.

8. The antenna structure, according to claim 7, wherein said ground plane structure comprises second circuitry to selectively electrically connect/disconnect the first portion of said first ground plane element and the third portion of said second ground plane element respectively with/from the second portion of said first ground plane element and with/from the fourth portion of said second ground plane element.

9. The antenna structure, according to claim 8, wherein said ground plane structure comprises second circuitry to control the amplitude and phase of the current ($I_1$) flowing across said slot or cut-out.

10. The antenna structure, according to claim 7, wherein said ground plane structure comprises a third ground plane element, which is electrically connected to said first and second ground plane elements and which is formed by a sixth conductive track deposited on a second layer of said substrate, opposite to said first surface.

11. The antenna structure, according to claim 7, wherein said first circuitry elements are switching devices, which are positioned at said first layer and which are powered by respective bias lines electrically connected to a driving circuit.

12. The antenna structure according to claim 11, wherein it comprises third circuitry to electrically decouple said bias lines from said passive radiating elements.

13. An electronic device comprising the antenna structure according to claim 1.

14. The antenna structure according to claim 2, wherein said active radiating element, said passive radiating element and said ground plane element are formed by respective conductive tracks deposited on one or more layers of a supporting substrate.

15. The antenna structure of claim 1, wherein the slot or cut-out is a recess in the ground plane element.

16. The antenna structure of claim 1, wherein the ground plane element has a U-shape, and the slot or cut-out is the central recess of the U-shape.

* * * * *